United States Patent [19]

Cho

[11] Patent Number: 4,748,973

[45] Date of Patent: Jun. 7, 1988

[54] PNEUMATIC MASSAGE DEVICE

[76] Inventor: Robert J. Cho, 561 Dry Creek Rd., Monterey, Calif. 93940

[21] Appl. No.: 10,265

[22] Filed: Feb. 2, 1987

[51] Int. Cl.[4] ..... A61H 9/00

[52] U.S. Cl. ..... 128/40; 128/38

[58] Field of Search ..... 128/40, 38

[56] References Cited

U.S. PATENT DOCUMENTS

| | | | |
|---|---|---|---|
| 1,378,922 | 5/1921 | Ward | 128/40 |
| 2,314,590 | 3/1943 | McCarty | 128/40 |
| 2,642,863 | 6/1953 | Gordon | 128/38 |
| 2,795,224 | 6/1957 | Brandenburg | 128/24.1 |
| 3,292,613 | 12/1966 | MacLeod | 128/40 |
| 3,396,720 | 8/1968 | Ohkubo | 128/40 |
| 3,516,411 | 6/1970 | Adler | 128/24.1 |
| 3,720,205 | 3/1973 | Liebman | 128/63 |
| 3,785,369 | 1/1974 | Tallent | 128/40 |
| 3,841,322 | 10/1974 | Spelio | 128/40 |
| 3,961,625 | 6/1976 | Dillon | 128/40 |
| 4,157,088 | 6/1979 | Gracey | 128/24.1 |
| 4,512,054 | 4/1985 | Clark | 128/63 |
| 4,513,736 | 4/1985 | Tharber | 128/24.1 |
| 4,928,368 | 1/1984 | Torio | 128/40 |

*Primary Examiner*—Edgar S. Burr
*Assistant Examiner*—Tonya Lamb
*Attorney, Agent, or Firm*—Schroeder, Davis & Orliss Inc.

[57] ABSTRACT

A pneumatic massage device for applying suction to the skin including a suction cup member, a solenoid operated needle valve and a solenoid operated vacuum pump is provided. A pair of positioning straps are attached to the suction cup member to facilitate a person positioning the suction cup member on any desired area of his body without the assistance of another person. Each strap includes a form-fitted handle with a push-button switch to independently control the needle valve and vacuum pump.

1 Claim, 2 Drawing Sheets

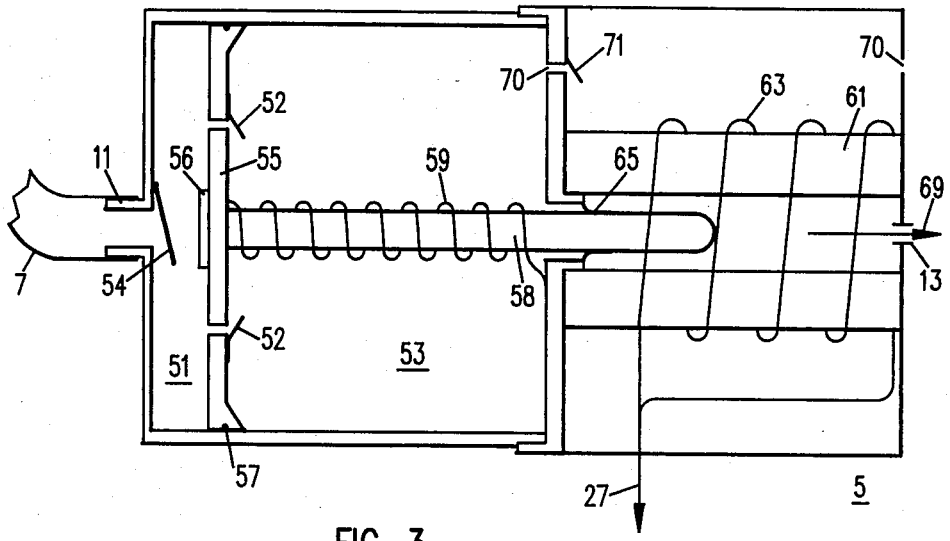
FIG. 3
FIG. 4
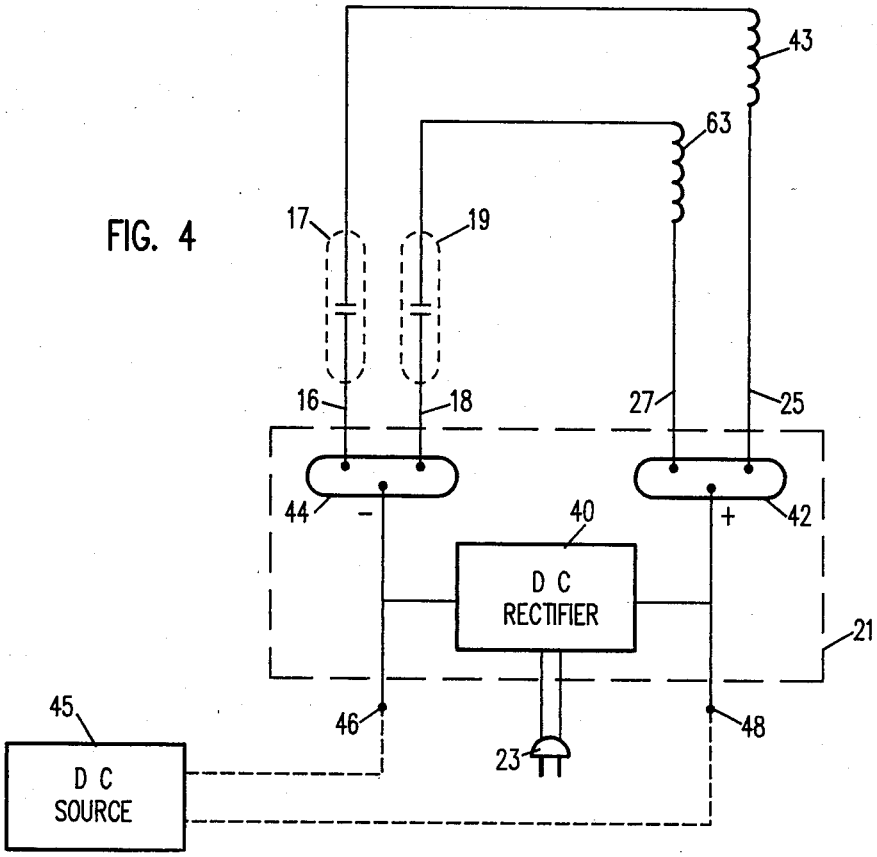

PNEUMATIC MASSAGE DEVICE

BACKGROUND OF THE INVENTION

The present invention relates generally to a massage apparatus utilizing variable air suction and, more particularly, to a massage device by which a person may apply variable air suction for pneumatic massage to any selected portion of his body.

It is well known in the prior art to utilize air suction to stimulate and improve the circulation of the blood under the skin and otherwise massage various surface portions of the human body. U.S. Pat. No. 2,441,868 entitled "Apparatus for Massaging Portions of the Body", issued on May 18, 1948 to Lola A. Casnati discloses a massage device comprising a cup-like member having a stem through which air may be evaculated. A rubber bulb provided with a one-way valve for discharging air when the bulb is compressed is coupled to the stem with a rubber tube. The cup-like member is placed and moved over the surface of the face and other parts of the skin to be massaged. Simultaneously, the rubber bulb is repeatedly compressed and allowed to expand to produce a partial vacuum within the void formed by the cup-like member in contact with the surface of the skin thus effecting a massaging action as the cup-like member is moved over the surface of the skin.

U.S. Pat. No. 3,841,322 entitled "Applicator for Pneumatic Therapy", issued on Oct. 15, 1974 to Peter N. Spelio discloses an apparatus for use in pneumatic therapy and a method of using such an apparatus to massage and reestablish facial and neck tissue. The method is practiced by contacting the appropriate skin areas of the face and neck with one or more disposable applicator cups coupled by tubing to a source of alternating suction and relaxation to effect cyclic mechanical manipulation or massage of the skin.

A person using the above described prior art massage devices requires assistance in order to effectively treat all portions of the body. For example, without the assistance of another person, massage of certain areas of the back is unobtainable. Further, the massage device disclosed by Casnati is manually operated and does not produce an adequate amount of suction for its intended purpose.

SUMMARY OF THE INVENTION

In accordance with the principles of the present invention, a vacuum massage device comprises a suction cup member coupled to a solenoid actuated piston-displacement vacuum pump to provide a vacuum within the suction cup member and having a solenoid actuated needle valve to relieve the vacuum. A nylon strap member is threaded through brackets disposed on opposite sides of the suction cup member to form a right-hand strap and a left-hand strap to enable a person to position the suction cup member on selected portions of the body, such as the middle of the back. A manually-operated push-button switch atached at the free end of each strap allows operation of the vacuum pump and the needle valve simultaneously with positioning of the suction cup member. In operation, the suction cup member is positioned on the surface of the skin at a desired area of the body and the suction pump is momentarily actuated to create a partial vacuum within the void defined by the suction cup member and the surface of the skin. The needle valve is then momentarily actuated to relieve the vacuum. The process is repeated as desired thus massaging that portion of the body and stimulating the blood circulation underneath the skin.

Further features and advantages will be apparent from the following description, reference being had to the accompanying drawings wherein a preferred embodiment of the present invention is illustrated.

BRIEF DESCRIPTION OF THE DRAWINGS

FIG. 3 is a sectional view of the piston-displacement vacuum pump shown in FIG. 1; and FIG. 4 is a schematic diagram showing the electrical control system of the vacuum massage device illustrated in FIG. 1.

DETAILED DESCRIPTION OF THE PREFERRED EMBODIMENT

Figure 1:
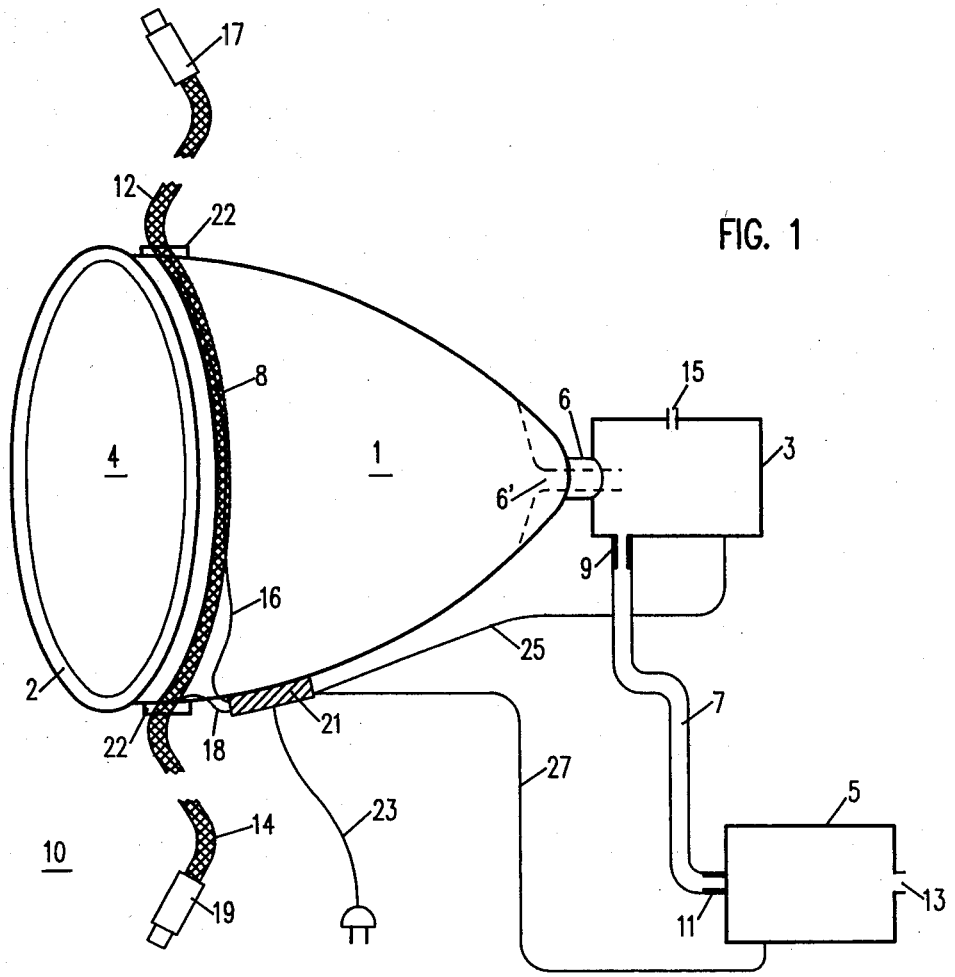
FIG. 1 is a perspective view of a vacuum massage device according to the principle of the present invention.

Referring now to FIG. 1, a vacuum massage device 10 according to the principles of the present invention comprises a suction cup member 1, needle valve assembly 3 coupled to the suction cup member 1, needle valve assembly 3 coupled to the suction cup member by nipple 6 and vacuum pump 5 coupled to the needle valve assembly 3 by flexible tubing 7.

Suction cup member 1 is a generally frusto-conical shell with the major diameter end 4 being open and having an upwardly and outwardly curved peripheral flange 2 adapted to form a wide, firm and rounded smooth surface for contact with the surface of the skin. At the apex of the suction cup 1 an opening 6' communicates with the interior of the suction cup 1 and cylindrical nipple 6 extends from the periphery of opening 6' to couple the needle valve assembly 3 to the suction cup member 1. Suction cup 1 includes brackets 22 attched to opposite sides of the shell near the periphery flange 2. Strap member 8 is inserted through brackets 22 around half the circumference of the shell with end portions of the strap member extending outwardly from the brackets away from the suction cup 1 to form a pair of straps 12 and 14 to facilitate positioning maneuvering the suction cup 1 on the body. Attached to the free end of each strap 12 and 14 are push-button switches 17 and 19, respectively. Push-button switches 17 and 19 provide a means to actuate the needle valve assembly 3 and vacuum pump 5 respectively, as desired. Push-button switches 17, 19 may be form-fitted to a human hand and also serve as handles to facilitate grasping and retaining the straps 12, 14. Push-button switches 17, 19 are coupled to the needle valve assembly 3 and the vacuum pump 5, respectively, and to a power distribution circuit 21. Power cord 23 couples AC power to the power distribution circuit 21.

Figure 2:
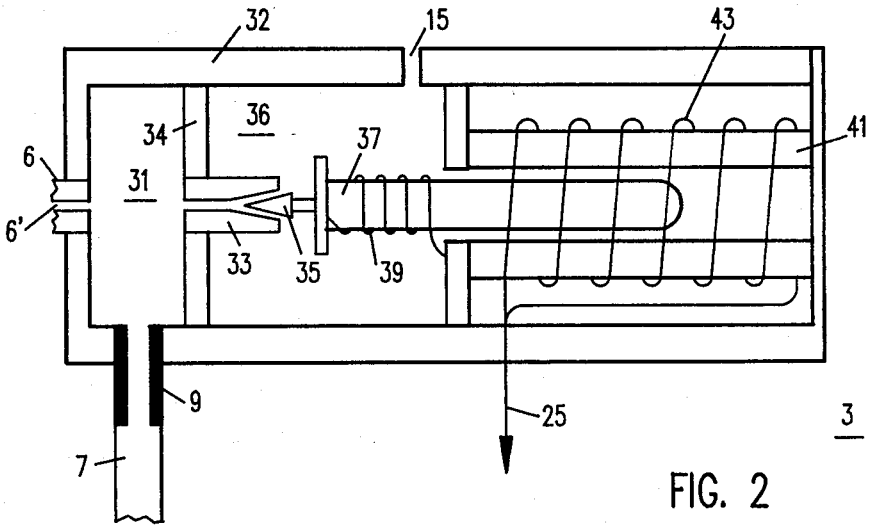
FIG. 2 is a sectional view of the solenoid actuated needle valve shown in FIG. 1.

Referring now also to FIG. 2, needle valve assembly 3 comprises a solenoid operated needle valve and provides coupling between the suction cup 1 and the vacuum pump 5 and is mounted on nipple 6. Vacuum chamber 31 formed by casing 32 and interior wall 34 communicates with the interior of suction cup 1 via opening 6' and is coupled to the vacuum pump 5 by tubing 7 attached to nipple 9 through casing 32. Vacuum chamber 31 is coupled to chamber 36 via needle valve seat 33, which is at atmospheric pressure via opening 15. Needle 35 formed at one end of a magnetic rod 37 is retained in closed position in needle valve seat 33 by the action of spring 39. When current flows through coil 43, rod 37 is drawn into core 41 by magnetic action and needle valve 33,35 is opened to couple vacuum chamber 31 to the atmosphere. When power is removed from coil 43, spring 39 will seat needle 35 in needle valve seat 33.

Referring now also to FIG. 3, vacuum pump 5 is a solenoid-operated piston displacement type vacuum pump and is coupled to the needle valve assembly 3 via tubing 7 attached to nipple 11. Piston 55 is attached to one-end of magnetic piston rod 58. When current flows through coil 63, piston rod 58 is drawn into hollow solenoid core 61 in the direction shown by arrow 69. As the piston rod 58 is drawn into core 61, piston 55 moves in direction 69 and the air in chamber 53 is forced out through flexible seal 65 and opening 13 creating a partial vacuum in chamber 51 and opening flapper valve 54. Air is drawn into chamber 51 from suction cup 1 via vacuum chamber 31 and tubing 7 to provide a partial vacuum in the suction cup 1 when it is positioned on the surface of the skin. When coil 63 is deenergized, spring 59 urges piston 55 back to the left closing flapper valve 54, opening flapper valves 52 and forcing the air in chamber 51 to chamber 53. When piston 55 is fully extended to the left, rubber seal 56 holds flapper valve 54 closed to retain the partial vacuum in the suction cup 1. O ring 57 provides a seal between the chamber 51, 53 walls and piston 55.

Flexible seal 65 also acts as a guide for piston rod 58 during its travel into and out of core 61. If the cross-sectional area of flexible seal 65 is inadequate for free flow of air out of chamber 53 to allow rapid operation of piston 55, vents 70 and flapper valve 72 may be provided to facilitate faster movement of air out of chamber 53 as required.

Referring now to FIG. 4, power distribution circuit 21 provides DC power to solenoid coils 43 and 63. Power cord 23 provides AC power to DC rectifier 40 which provides DC power to positive bus 42 and negative bus 44. A separate portable DC source 45 may be connected to terminals 46 and 48 to provide a completely portable device for use in remote areas where AC power may not be available. The coils 43 and 63 will also operate on AC power and the DC rectifier 40 may be eliminated to reduce costs and size of the electrical circuit. Further, AC power may be connected to the coils 43 and 63 in such a manner that the power to coil 43 is 180 degrees out of phase with the. power to coil 63 to provide a pulsating vacuum. Coils 43 and 63 are energized by push-button switches 17 and 19, respectively. Push-button switches 17, 19 are incorporated in the form-fitted plastic handles attached at the end of each strap 12,14, respectively and are manually actuated by the operator.

In actual practice the operator, by use of the straps 12, 14, positions the suction cup 1 at a desired anatomical area of his body, lightly placing the reversely flanged open end 4 of the suction cup 1 into contact with the skin. Push button switch 19 is then momentarily actuated to operate the vacuum pump 5 and draw a partial vacuum in the suction cup 1. Repeated actuation of the vacuum pump 5 will increase the vacuum drawn. Actuation of push-button switch 17 will energize coil 43 to open the needle valve 33, 35 to relieve the vacuum. The vacuum cup 1 is then moved a short distance, approximately one-sixth of an inch, while the suction cup 1 remains in contact with the skin and the process is repeated. The vacuum pump 5 and the needle valve assembly 3 can be cyclically actuated respeatedly to produce a pulsating massage effect. If the coils 43 and 63 are connected directly to AC power as described herein above, the push button switches 17, 19 may be actuated continously to provide a pulsating vacuum at the line frequency, i.e., 60 cycles a second.

The suction cup 1 may be made in various sizes and formed of polyethylene or other suitable, relatively inexpensive, plastic material. The rounded flange 2, which may be disposable, is made of a supple rubber or other suitable material capable of forming a seal with the skin yet not being abrasive to the skin. The straps 12, 14 may be made of nylon or other suitable material and are required to be of sufficient length to allow the operator to easily and conveniently place and maneuver the suction cup 1 at any desired area of the human body. Tube 7 is rubber or vinyl tubing of sufficient length to allow positioning the suction cup 1 at any desired area of the human body.

While the present invention has been described with reference to particular embodiments thereof, it will be understood that numerous modifications may be made by those skilled in the art without actually departing from the scope of the invention. Other combinations of vacuum pump and needle valve assembly may be substituted, the requirement being only to produce a suction-relaxation action. For example, light weight, compact and integral vacuum pump and needle valve assemblies are presently available which may be mounted on the suction cup thus eliminating separate valve and vacuum pump units and the need for long lengths of coupling tubing.

I claim:

1. A pneumatic massage device comprising:

a generally conical shaped suction cup having an opening at a major diameter end thereof, said suction cup selectively disposed on portions of the surface of a human back, said major diameter end in contact with said surface and forming a void within the volume defined by said suction cup in contact with said surface;

vacuum pump means coupled to an apex of said suction cup for producing a partial vacuum within said void;

valve means coupled to said suction cup selectively coupling said void to the atmosphere;

a pair of elongated straps, one end of each of said straps attached to opposite sides of the perimeter of said opening for positioning said suction cup at selected positions on the human back, each of said straps having handle means attached at its other end; and each of said handle means including switch means, one of said switch means electrically coupled to said vacuum pump means for controlling the operation of said vacuum pump means and the other one of said switch means electrically coupled to said valve means for controlling the operation of said valve means.

* * * * *